US005276931A

United States Patent [19]

Kärcher et al.

[11] Patent Number: 5,276,931

[45] Date of Patent: Jan. 11, 1994

[54] EQUIPMENT FOR LAYING A TRACK-SUPPORTING BRIDGE

[75] Inventors: Hans-Jürgen Kärcher, Karben; Walter Kinzel, Mainz, both of Fed. Rep. of Germany

[73] Assignee: Man Gutehoffnungshütte Aktiengesellschaft, Oberhausen, Fed. Rep. of Germany

[21] Appl. No.: 927,123

[22] Filed: Aug. 7, 1992

[30] Foreign Application Priority Data

Aug. 16, 1991 [DE] Fed. Rep. of Germany ..... 4127106

[51] Int. Cl.[5] ..... E01D 15/12

[52] U.S. Cl. ..... 14/2.5

[58] Field of Search ..... 14/2.6, 2.4, 2.5

[56] References Cited

U.S. PATENT DOCUMENTS 3,486,180 12/1969 Söffge ..... 14/2.4
3,488,787 1/1970 Söffge ..... 14/2.4
3,492,683 2/1970 Wagner et al. ..... 14/2.5
3,562,829 2/1971 Söffge ..... 14/2.4
5,042,102 8/1991 Moers et al. ..... 14/2.5 X
5,117,525 6/1992 Kärcher ..... 14/2.5

*Primary Examiner*—Timothy V. Eley
*Attorney, Agent, or Firm*—Max Fogiel

[57] ABSTRACT

An arrangement for laying a bridge, in which a vehicle carries a plurality of track support sections of a bridge to be laid. The vehicle has a laying device which includes a laying support with cantilevering rails traveling on rollers. Telescoping stays are located at ends of the laying support, and a left-side track-laying device and a right-side track-laying device are mounted on telescoping shafts. The telescoping shafts are displaced hydraulically across the longitudinal axis of the vehicle. Each of the track-laying device on the laying support has provision for placing the track support sections. A piston-and-cylinder is located on arms mounted at ends of a horizontal one of the shafts, whereas piston-and-cylinder is mounted on ends of a rear one of the shafts.

4 Claims, 3 Drawing Sheets

EQUIPMENT FOR LAYING A TRACK-SUPPORTING BRIDGE

BACKGROUND OF THE INVENTION

The invention concerns equipment for laying a bridge, comprising first a bridge mounted on a vehicle and consisting of several track-support pair sections and second a laying device consisting of a laying support with cantilevering rails that travel on rollers, of a device for introducing the bridge sections, and of telescoping stays at the ends of the laying support.

Transportable bridges that can be narrowed for moving and loaded on what are called follower vehicles are known. The bridge components are widened by and on the follower before being shifted to the laying vehicle.

A bridging system consisting of several uniform bridge sections in the form of pairs of track supports is known from the as-yet unpublished German 4 126 250.6 dated Aug. 7, 1991. One bridge section or several bridge sections assembled together constitute a two-track bridge.

Also known are bridge-laying vehicles that transport several bridge components with a fixed width, whereby the laying device is positioned between the two track supports in the bridge components. The constant width of the bridge component is determined from the widest wheel track of the vehicles that will be driven over the finished bridge. At such widths, however, only specific routes can be traveled unimpeded.

SUMMARY OF THE INVENTION

The object of the present invention is accordingly a bridge-laying vehicle with multiple-function bridge-laying equipment, meaning a single vehicle with devices for transporting, spreading apart, laying, and recovering track-support shaped bridge components.

The laying device in accordance with the invention consists of a left and of a right laying component that slide across the longitudinal axis of the bridge-laying vehicle. Several similar track-support shaped bridge sections rest on the bridge-laying vehicle. The bridge sections on the vehicle are spread apart to the requisite track gauge, individually connected, and laid by cantilevering rails supported by the laying support.

A bridge-laying vehicle with bridge-laying equipment in accordance with the invention eliminates the need for a follower to transport and spread apart the bridge components.

Another advantage of the invention is an articulating arm between the pivoting arm that connects the laying support to the transport vehicle and the base of the telescoping stays on the laying support. The result is a parallelogram that not only prevents bending moments in the telescoping stays while the bridge components are being laid but can also displace the center of gravity of the bridge-laying vehicle forward, so that longer bridge sections can be laid by the same system, recovered in the same way, and transported as well. In its transport position, furthermore, the parallelogram ensures minimal obstruction of the driver's view, whereby the base of the stays will accordingly remain within a permissible angle of incline.

The driver alone can lay a bridge from the protected bridge-laying vehicle in unfavorable weather and with limited visibility.

BRIEF DESCRIPTION OF THE DRAWINGS

The equipment in accordance with the invention will now be specified with reference to the schematic drawing, wherein.

DESCRIPTION OF THE PREFERRED EMBODIMENTS

Figure 1:
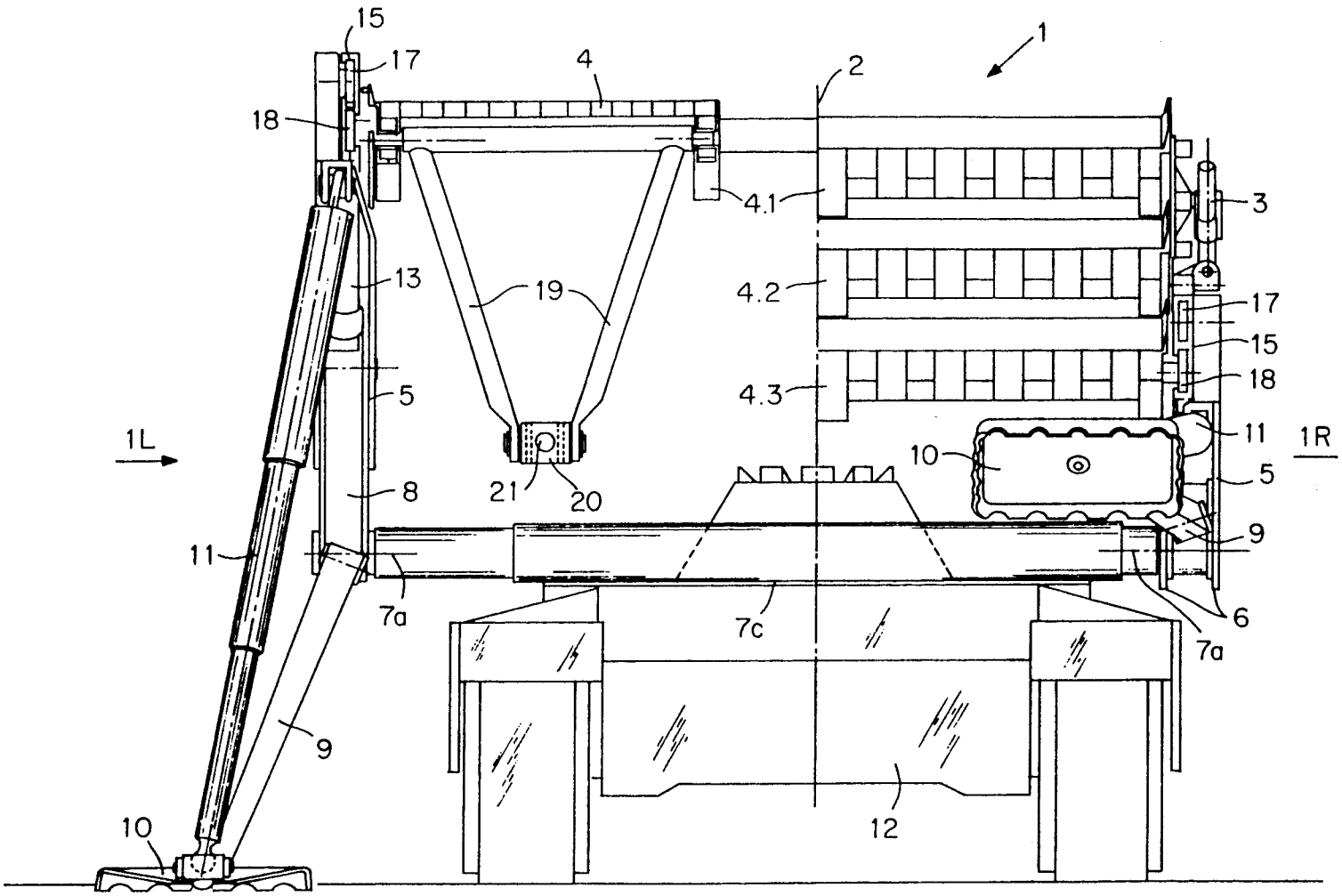
FIG. 1 is a front view of the bridge-laying vehicle, in the laying state to the left and in the transport state to the right.

FIG. 1 illustrates a bridge-laying vehicle 12, preferably a track-laying vehicle, from the front, with its left-side track-laying component 1L in the track-laying state and its right-side track-laying component 1R ready for transporting bridge components 4. When bridge-laying vehicle 12 is in operation of course both components will be either in the track-laying or in the transport state.

Telescoping shafts *7a* and *7b* are accommodated as will be evident from FIGS. 2 through 5 in square pipes and are activated in a practical way by two-way piston-and-cylinder mechanisms. Synchronization is ensured by known controls. If the shafts are in two sections of course, simple one-way piston-and-cylinder mechanisms with recuperation springs can be employed instead of two-way piston-and-cylinder mechanisms.

The device that displaces the two axial halves can also be a motorized spindle that engages racks on each half.

A laying device 1 is represented in the transport state to the right of the vehicle's longitudinal axis 2. The illustrated embodiment has a stack of three track-support sections 4.1–4.3 connected to the sections on the left by telescoping transverse pipes and adjusted to the requisite gauge by spreading the left-side track-laying component 1L and the right-side track-laying component 1R apart.

A left-side base 10 for telescoping stays 11 will be evident secured to an articulating arm 9 above horizontal shaft *7a*. A laying-support bushing 6 surrounds horizontal shaft *7a*. Above it are a cantilevering rail 15 and components of a pivoting bridge-section introducing device 3.

Laying device 1 is represented to the left of the longitudinal vehicle axis 2 in FIG. 1 at the operating stage concerned with attaching and laying bridge sections 4.1–4.3. Horizontal shaft *7a* has been extended out as far as necessary for the laying procedure. A telescoping stay 11 articulated to a laying support 5 and arm 9, articulated to a pivoting arm 8, engage telescoping-stay base 10, which has been lowered to the ground. Ready-to-lay bridge components 4 are positioned on cantilevering rail 15 with their extended pivoting sections 19, attachments 20, and traction-application components 21.

Figure 2:
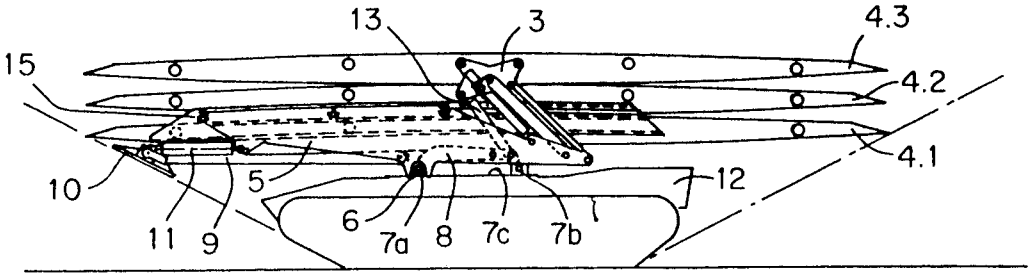
FIG. 2 illustrates the bridge-laying vehicle with three track-support pair sections in the transport state.

FIG. 2 is a side view of the bridge-laying vehicle, a track-laying vehicle in the present case, in the transport position with a pivoting laying support 5 resting with its bearing bushing 6 on the transversely displaceable forward shaft *7a* of pivoting arm 8 and with its piston-and-cylinder mechanism 13 against a rear shaft *7b*. Shafts *7a* and *7b* are connected to bridge-laying vehicle 12 by square pipes and a framework base *7c*. Articulating arm 9 positions telescoping-stay base 10 against telescoping stays 11 within the vehicle's permissible angle of inclination. Track-support sections 4.1–4.3 are stacked inside bridge-section introducing device 3 and on cantilevering rail 15.

Figure 3:
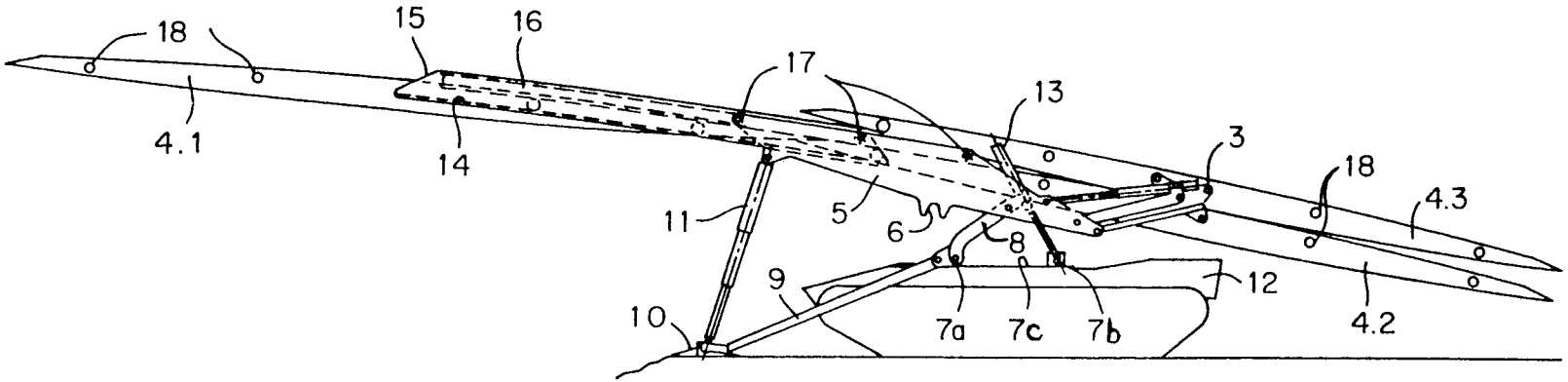
FIG. 3 illustrates the bridge-laying vehicle with three spread-apart track-support pair sections during the laying process and with the foot stay extended.

FIG. 3 is a side view of track-laying vehicle 12 with its pivoting laying support 5 during the track-laying procedure, whereby a piston-and-cylinder mechanism 13 has pivoted arm 8 up around horizontal shaft *7a*. Telescoping stay 11 has been extended and telescoping-stay base 10 has been lowered and secured in position and attached to pivoting arm 8 by way of articulating arm 9. A bridge component 4.1 with lateral rollers 18 is accommodated in the lower roller track 14 on cantilevering rail 15. The rail can now be displaced again between upper roller track 16 and the rollers 17 on laying support 5.

The remaining track-support sections 4.2 and 4.3 are in the pivoted-back bridge-section introducing device 3 in the transport position, ready for the assembly of an overall bridge component 4.

Bridge-section introducing device 3, which parallels the rear of laying support 5, pivots to allow the track-support sections 4.2 and 4.3 it accommodates to be positioned at the appropriate attaching point so that the bridge component 4.1 in cantilevering rail 15 can be immediately attached by retracting the rail.

Figure 4:
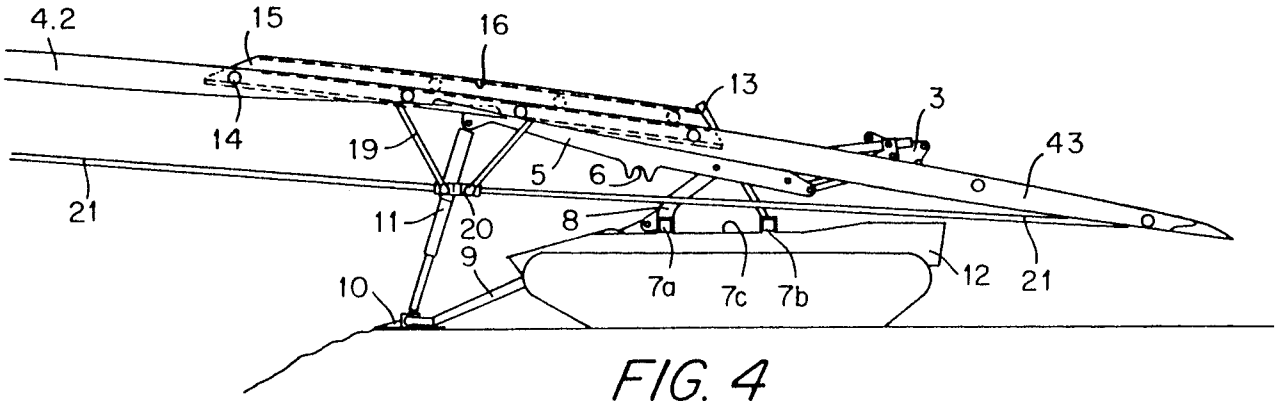
FIG. 4 illustrates the bridge-laying vehicle with spread-apart track-support pair sections during the extending and connecting procedures prior to laying.

FIG. 4 is a side view of track-laying vehicle 12 with laying support 5 lifted onto telescoping-stay base 10 by telescoping stays 11 on the one hand and over pivoting arm 8 by piston-and-cylinder mechanism 13 on the other into the position for attaching track-support sections 4.2 and 4.3. These sections have already been connected through attachments 20 by the outward pivoted sections 19, and traction-application components 21 are tensioned.

Figure 5:
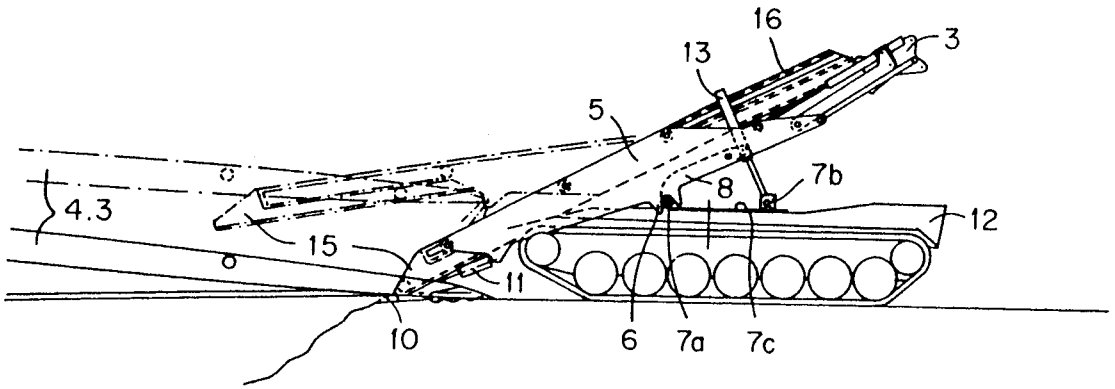
FIG. 5 illustrates the bridge-laying vehicle depositing the connected bridge component on the near band subsequent to the laying procedure.

FIG. 5 is another side view of bridge-laying vehicle 12 with laying support 5 pivoted down, depositing a bridge section 4.3 on the near bank. Laying support 5 rests on bushing 6 against horizontal shaft *7a*, pivoting arm 8 and piston-and-cylinder mechanism 13 are raised, and telescoping stay 11 is inserted.

We claim:

1. An arrangement for laying a bridge, comprising: a vehicle with a longitudinal axis; a plurality of track support sections of a bridge to be laid mounted on said vehicle; laying means on said vehicle and having a laying support with cantilevering rails traveling on rollers; means on said laying means for placing said track support sections; telescoping stays at ends of said laying support; a left-side track-laying means and a right-side track-laying means mounted on telescoping shafts; hydraulic means for displacing said telescoping shafts across said longitudinal axis of said vehicle; said means for placing said track support sections being mounted in each of said track-laying means on said laying support, said shafts comprising a horizontal shaft and a rear shaft; piston-and-cylinder means on arms mounted at ends of said horizontal shaft; said piston-and-cylinder means being mounted on ends of said rear shaft.

2. An arrangement as defined in claim 1, wherein said arms are pivoting arms, each of said telescoping stays having a base; and an articulating arm between said base of each telescoping stay and each of said pivoting arms.

3. An arrangement as defined in claim 1, wherein said laying support has a bearing bushing, said laying support resting with its bearing bushing on said horizontal shaft when said laying support is in a transport position and in a laying position.

4. An arrangement for laying a bridge, comprising: a vehicle with a longitudinal axis; a plurality of track support sections of a bridge to be laid mounted on said vehicle; laying means on said vehicle and having a laying support with cantilevering rails traveling on rollers; means on said laying means for placing said track support sections; telescoping stays at ends of said laying support; a left-side track-laying means and a right-side track-laying means mounted on telescoping shafts; hydraulic means for displacing said telescoping shafts across said longitudinal axis of said vehicle; said means for lacing said track support sections being mounted in each of said track-laying means on said laying support, said shafts comprising a horizontal shaft and a rear shaft; piston-and-cylinder means on arms mounted at end of said horizontal shaft; said piston-and-cylinder means being mounted on ends of said rear shaft; said arms being pivoting arms, each of said telescoping stays having a base; and an articulating arm between said base of each telescoping stay and each of said pivoting arms; said laying support having a bearing bushing, said laying support resting with its bearing bushing on said horizontal shaft when said laying support is in a transport position and in a laying position.

* * * * *